US005527101A

United States Patent [19]

Kato et al.

[11] Patent Number: 5,527,101

[45] Date of Patent: Jun. 18, 1996

[54] CASTING DEVICE, METHOD FOR USING THE DEVICE, CASTING DEVICE OF VEHICLE WHEEL, METHOD FOR USING THE DEVICE, AND VEHICLE WHEEL

[75] Inventors: Takashi Kato; Masami Yamamoto; Masaru Kurebayashi; Masaaki Uruma; Hisao Totsuka, all of Shizuoka-ken, Japan

[73] Assignee: Asahi Katantetsu Kabushiki Kaisha, Tokyo, Japan

[21] Appl. No.: 271,211

[22] Filed: Jul. 5, 1994

Related U.S. Application Data

[63] Continuation of Ser. No. 13,251, Feb. 3, 1993, abandoned, which is a continuation of Ser. No. 608,197, Nov. 2, 1990, abandoned, which is a division of Ser. No. 388,322, Jul. 31, 1989, abandoned.

[30] Foreign Application Priority Data

| | | | |
|---|---|---|---|
| Jul. 31, 1988 | [JP] | Japan | 63-191445 |
| Jul. 31, 1988 | [JP] | Japan | 63-191446 |
| Jul. 31, 1988 | [JP] | Japan | 63-191447 |
| Jul. 31, 1988 | [JP] | Japan | 63-191448 |
| Jul. 31, 1988 | [JP] | Japan | 63-191453 |
| Jul. 31, 1988 | [JP] | Japan | 63-191454 |
| Nov. 29, 1988 | [JP] | Japan | 63-302107 |
| Nov. 30, 1988 | [JP] | Japan | 63-304880 |
| Jul. 27, 1989 | [JP] | Japan | 1-196378 |
| Jul. 27, 1989 | [JP] | Japan | 1-196379 |
| Jul. 27, 1989 | [JP] | Japan | 1-196380 |
| Jul. 27, 1989 | [JP] | Japan | 1-196381 |

[51] Int. Cl.[6] ..... B60B 1/06; B22D 27/04

[52] U.S. Cl. ..... 301/65; 164/126; 164/348

[58] Field of Search ..... 164/348, 127, 164/122.1, 126, DIG. 14; 301/65, 122, 124, 125, 126, 127

[56] References Cited

U.S. PATENT DOCUMENTS

| | | | |
|---|---|---|---|
| 728,956 | 5/1903 | Mitchell | 164/720 |
| 1,015,362 | 1/1912 | Vial | 164/127 |
| 1,908,740 | 5/1933 | Fahrenwald | 164/127 |
| 1,983,177 | 12/1934 | Lee | 164/127 |
| 2,004,335 | 3/1929 | Merriman | 164/127 |

(List continued on next page.)

FOREIGN PATENT DOCUMENTS

| | | | |
|---|---|---|---|
| 2545178 | 5/1976 | Germany | 164/306 |
| 2704322 | 8/1977 | Germany | 164/309 |
| 2704321 | 8/1977 | Germany | 164/309 |
| 3247129 | 6/1984 | Germany | 164/306 |
| 53-73426 | 6/1978 | Japan . | |
| 58-81548 | 5/1983 | Japan | 164/119 |
| 61-180659 | 8/1986 | Japan | 164/120 |
| 62-118943 | 5/1987 | Japan | 164/122 |
| 63-72465 | 4/1988 | Japan | 164/98 |
| 63-242458 | 10/1988 | Japan | 164/305 |
| 63-281745 | 11/1988 | Japan | 164/305 |
| 241752 | 2/1990 | Japan | 164/120 |
| 725796 | 4/1980 | U.S.S.R. | 164/308 |
| 1587909 | 4/1981 | United Kingdom | 164/306 |
| 2196281 | 4/1988 | United Kingdom . | |

OTHER PUBLICATIONS

Steels, Microstructure and Properties RWK Honeycombe. pp. 22–23, 1981.

782955, Nov. 1980 Soviet Union 164/309.

*Primary Examiner*—Kurt Rowan
*Assistant Examiner*—Randy Herrick
*Attorney, Agent, or Firm*—Darby & Darby

[57] ABSTRACT

A cast aluminum alloy vehicle wheel has a central disk, a rim, and a rim carrying portion located between the rim and the central disk. The rim has an end or tip portion that is the farthest portion of the rim from the disk, and a barrel portion is located between the rim carrying portion and the rim end. The microstructure of the metal provides a dendritic arm spacing (DAS) that is smaller at the rim end than at the rim barrel. Additionally, the DAS of the barrel portion is less then at the central disk. The DAS of the rim carrying portion is equal or less then the DAS of the barrel portion on the rim. A high strength wheel is provided, especially at the rim.

8 Claims, 2 Drawing Sheets

U.S. PATENT DOCUMENTS

| | | | |
|---|---|---|---|
| 2,420,003 | 5/1947 | Miller | 164/DIG. 14 |
| 2,568,428 | 9/1951 | Billiar | 164/120 |
| 2,669,769 | 2/1954 | Peterson | 164/120 |
| 3,566,952 | 3/1971 | Lane | 164/120 |
| 3,656,539 | 4/1972 | Zickefoose | 164/309 |
| 3,856,360 | 12/1974 | Lindberg | 301/65 |
| 4,165,131 | 8/1979 | Thompson | 164/DIG. 14 |
| 4,252,173 | 2/1981 | Charbonnier | 164/119 |
| 4,352,388 | 10/1982 | Perrella | 164/305 |
| 4,606,396 | 8/1986 | Chandley | 164/350 |
| 4,771,818 | 9/1988 | Kenny | 164/113 |
| 4,889,177 | 12/1989 | Charbonnier et al. | 164/309 |

CASTING DEVICE, METHOD FOR USING THE DEVICE, CASTING DEVICE OF VEHICLE WHEEL, METHOD FOR USING THE DEVICE, AND VEHICLE WHEEL

This is a continuation of application Ser. No. 08/013,251, filed Feb. 3, 1993, which is a continuation of Ser. No. 07/608,197 filed Nov. 2, 1990, which is a division of Ser. No. 07/388,322 filed Jul. 31, 1989, all abandoned.

BACKGROUND OF THE INVENTION

1. Field of the Invention

This invention relates to a vehicle wheel.

2. Brief Description of the Prior Art

A conventional aluminum vehicle wheel which is cast by means of a low pressure casting method is required to be shock tested and to a rotary bending test to determine if the wheel satisfies safety standards.

SUMMARY OF THE INVENTION

An object of the present invention is to provide a vehicle wheel which satisfies safety standards.

The object of the invention can be achieved by an aluminum alloy vehicle wheel characterized in that at a dendrite arm spacing measuring value, a DAS measuring value of a tip portion of a rim which is the most remote from a disk portion of the wheel being smaller than a measuring value of a rim body portion, a DAS measuring value of a rim carrying portion of said disk portion is smaller than a DAS measuring value of a central portion of said disk, said DAS measuring value of said rim carrying portion of said disk portion being equal to or smaller than said DAS measuring value of said rim body portion.

The above object and still further objects of the invention will immediately become apparent to those skilled in the art after consideration of the following preferred embodiments of the invention which are provided by way of example and not by way of limitation.

DETAILED DESCRIPTION OF THE EMBODIMENTS

Figure 1:
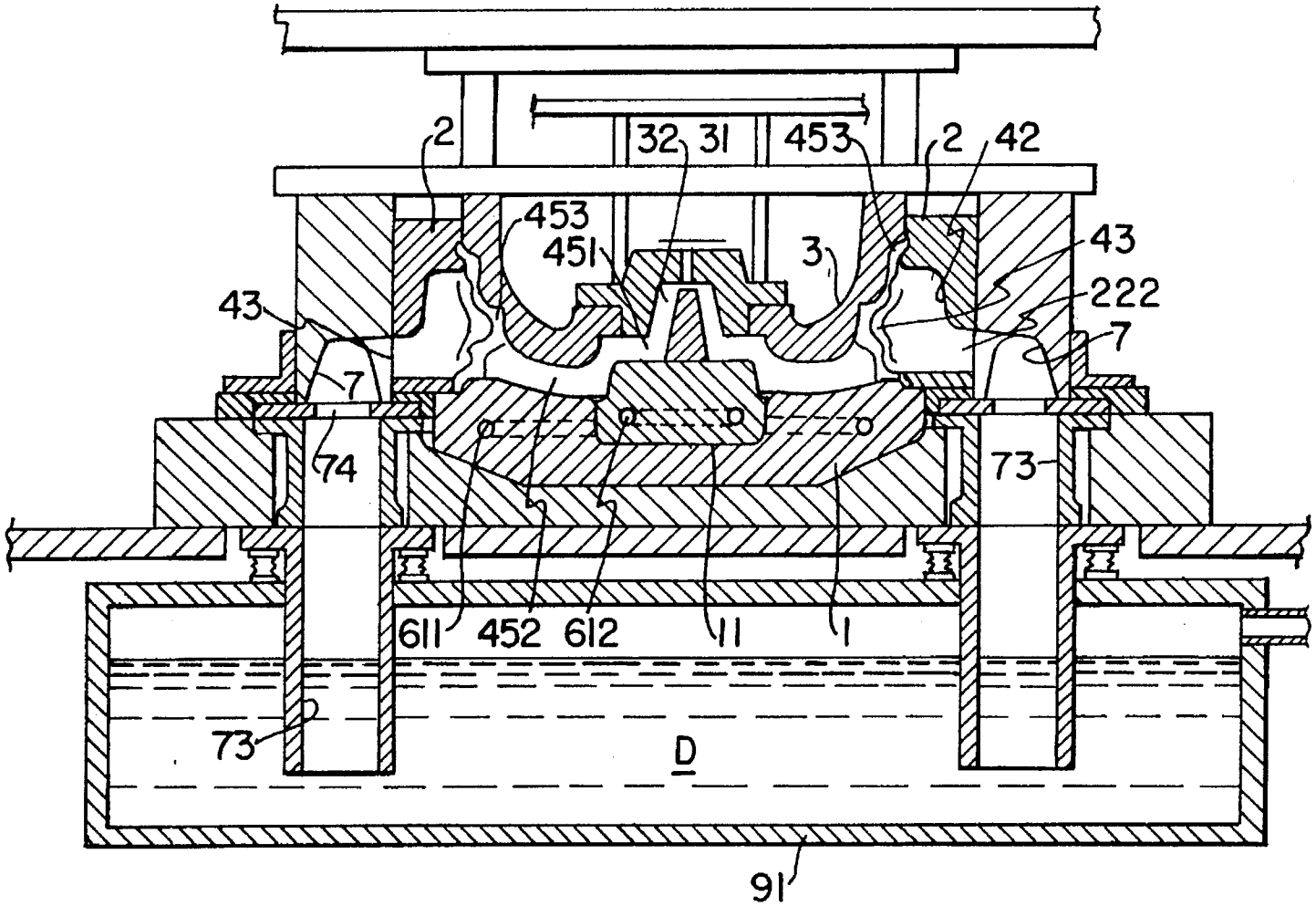
FIG. 1 is a sectional view of a casting device used to make a vehicle wheel according to the present invention.
Figure 2:
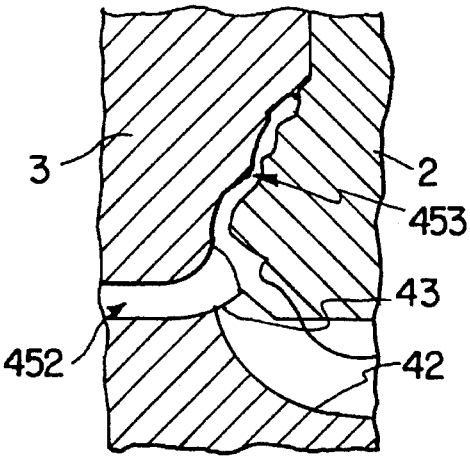
FIG. 2 is a sectional view of a gate portion of the casting device.

FIGS. 1 and 2 shows one embodiment of a casting device used to make a vehicle wheel according to the present invention. In the figure, the lower mold 1 corresponds to an outer side mold section. The upper mold 3 corresponds to a rear side mold section, and the horizontal mold 2 corresponds to a rim outer side mold section. One end of a hot melt fluid passage 7 communicates with the melt port 222 and the other end thereof communicates with a melt inlet port 223 which opens up below port 222. Also, melt inlet port 223 is connected to a feed melt pipe 73 through a flat plate-shaped filter 74. Furthermore, the melt flow passage 7 is mounted such that passage 7 can be interlocked with the nest 31 and the upper mold 3.

The vehicle wheel is cast by pressurizing the melt within furnace 91 which results in melt being pushed up through each feed pipe 73, past gate 43, and into the casting space. After the casting space is filled, a cooling fluid is circulated through cooling passages 611, 612 so that the lower mold, and the nest of the lower mold are cooled first. A primary cooling passage 611 is formed in the lower mold 1 and an auxiliary cooling passage 612 is formed in the next of the lower mold. A feeder chamber portion 32 of the casting space is disposed adjacent to (i.e., just below) a nest 31. Besides the feeder chamber 32, the casting space includes a disk forming space portion 451, a spoke forming space portion 452 and a rim forming space portion 453. A pair of gates 43 are disposed on diametrically opposite sides of the casting space. Each gate 43 is disposed between the rim forming portion 453 and the spoke forming space 452. Because a large space is available in the vicinity of the disk portion 451, the disk portion can be sufficiently cooled by cooling passages 611 612. As a result, the structure of the disk portion of the vehicle wheel, which is obtained by casting, can be miniaturized, and the strength thereof can be improved. Also, because the hot melt flow passage 7 communicates with a hot melt port that is disposed on the outer peripheral surface of the rim, by removing only the thin plate-shaped hot melt passage portion from the mold first, an occurrence of bending or separation of the thin plate-shaped hot melt passage portion can be prevented.

One embodiment of a vehicle wheel, which is made by the cast of FIGS. 1 and 2, will be described with reference to FIGS. 3–5.

As an indication of a size in a microstructure of a casting of an aluminum casting wheel, a dentrite arm spacing (DAS) is measured.

Figure 3:
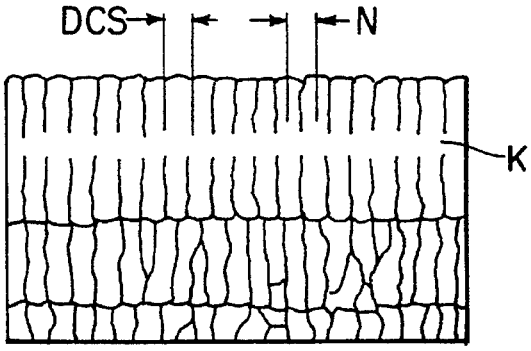
FIG. 3 is a schematic view showing a secondary branch (secondary arm) growing at each side of a main shaft of a dendrite in an aluminum alloy.

The dentrite in an aluminum alloy, as schematically shown in FIG. 3, has a secondary dendrite (secondary arm) growing at each side of a primary dentrite (k). By measuring DAS, a distance (N) between the secondary arms can be measured, in some cases, a cell size of the secondary arm (cell size of the dentrite, that is, DCS) is measured.

Figure 4:
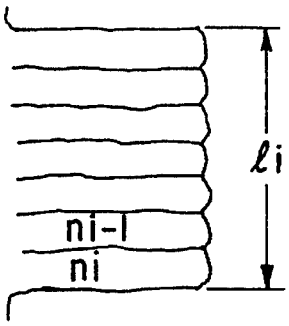
FIG. 4 is an explanatory schematic view showing a distance between a plurality of secondary arms and how to count the number of secondary arms measured within said distance.

The measurement of the DAS as shown in FIG. 4, is obtained by means of a secondary branch method, in which a plurality of values are obtained by dividing a distance between a plurality of secondary arms with the number of the secondary arms included in the distance and such obtained plurality of values are expressed in an average value.

Figure 5:
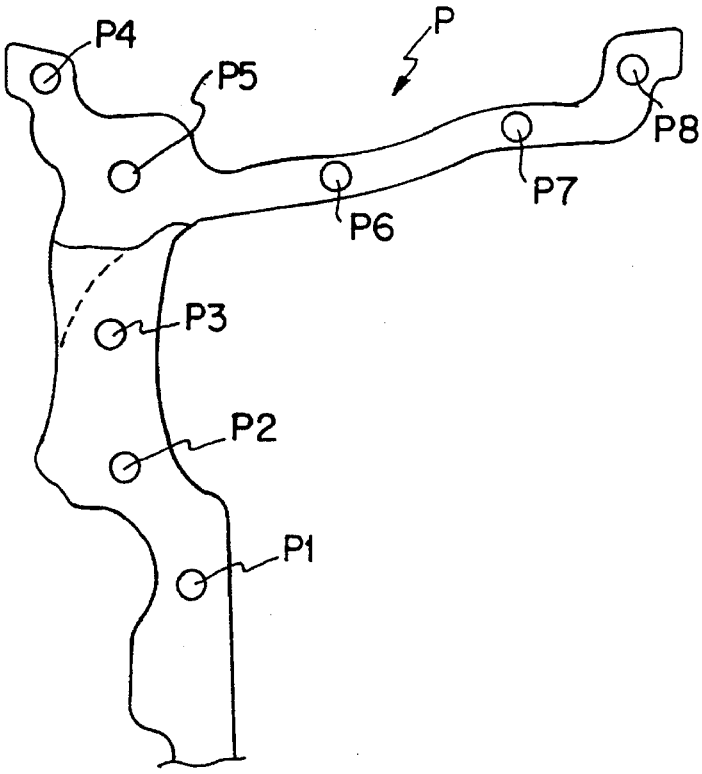
FIG. 5 is a partial sectional view obtained by cutting a vehicle wheel along a plane including a rotational shaft of a wheel and showing a position for taking a sample (the non-shown remaining half portion of the vehicle wheel is symmetrical with respect to the rotational shaft.

FIG. 5 is a sectional view obtained by cutting a vehicle wheel p by a plane including a wheel rotational shaft. A rim barrel portion (p6) and a rim carrying portion (p3) of a disk portion are strongly acted upon by a deflection moment during rotation of the wheel. Therefore, this portion is required for a casting to be high in strength.

It is generally understood that the strength of a casting is high, if the grain size is small, a measure of which is the DAS.

Accordingly, this follows that one with a small measured value of DAS is high in strength. Therefore, the DAS measured values of the rim barrel portion (p6) and the rim carrying portion (p3) in the disk portion are preferably small.

The jointing portion (p5) between the rim portion and the disk portion is larger in thickness in view of casting, and therefore, cooling of the hot melt is slower in the joining portion p5. As a result the crystal of the dentrite becomes somewhat coarse. However, the crystal is preferably as small as possible.

The following is a summary of preferable conditions in view of behavior of such wheel.

① The Measured value of DAS of the rim end portion p8 is smaller than the Measured value of DAS of the rim barrel portion p6.

② The Measured value of DAS of the rim carrying portion p3 of the disk portion is smaller than the measured valve of DAS of the central portion of the disk p1.

③ The measured value of DAS of the rim carrying portion p3 of the disk portion is equal to the DAS value of the rim barrel portion p6 or smaller than the measured value of DAS of the rim barrel portion p6.

One which satisfies the above conditions is preferable. A vehicle wheel having such value is high in strength at its required portion.

The DAS measured values in the vehicle wheel were as shown in Table 1.

Sample No. 1-1a-1 is the measured value of DAS of the central portion of the disk of the wheel.

Sample No. 1-1a-2 is the measured value of DAS of an intermediate portion (p2) of the disk of the wheel.

Sample No. 1-1a-3 is the measured value of DAS of the rim carrying portion (p3) of the disk portion of the wheel.

Sample No. 1-1a-4 is the measured value of DAS of the rim end portion (p4) of the disk side at the rim portion of the wheel.

Sample No. 1-1a-5 is the measured value of DAS of the jointed portion (p5) between the disk portion and the rim portion of the wheel.

Sample No. 1-1a-6 is the measured value of DAS of the rim barrel portion (p6) of the wheel.

Sample No. 1-1a-7 is the measured value of DAS of a portion (p7) of an intermediate position between the rim barrel portion and the rim end portion of the opposite disk side at the rim portion of the wheel.

Sample No. 1-1a-8 is the measured value of DAS of the rim end portion (p8) of the opposite disk side of the wheel.

In the same manner, the sample number "1" in the first position represents a sample of the vehicle wheel of the present invention. The sample number "1" in the middle position represents one corresponding to a portion of the weir front according to the casting bill and likewise "2" represents one corresponding to a portion rotated at 90° from the weir front according to the casting bill, and the sample numbers "1" in the last position represents one of the central portion (p1) of the disk, likewise "2" represents one of the middle portion (p2) of the disk, "3" represents the rim carrying portion (p3) of the disk portion of the wheel. "4" represents the rim end portion (p4) of the disk side at the rim portion nearest from the disk portion, "5" represents the jointed portion (p5) between the disk portion and the rim portion, "6" represents the rim barrel portion (p5), "7 represents the portion of the intermediate position between the rim barrel portion and the rim end portion, and "8" represents the rim end portion (p8) of the opposite disk side, and the characters "a" and "b" in the middle position respectively represent the first and second ones of samples collected from the same position of a plurality of vehicle wheels of the present invention.

Also, the number "2" in the first position represents the conventional vehicle wheel according to a low pressure casting method as a comparison example and similarly, "3" represents the conventional vehicle wheel according to a gravity casting method as a comparison example.

And, the shock test results and the rotary bending test results of the sample vehicle wheels picked up from a vehicle wheel group which has such measured values were excellent compared with those of the comparison examples of the conventional vehicle wheels.

Accordingly, a vehicle wheel of the present invention not only satisfies the safety standard but also ensures uniformity with high performance.

As described in the foregoing, according to the present invention, there can be provided a vehicle wheel in which there can be estimated a performance behavior for each part which was unable to make clear by a macrotest observation as a whole wheel such as a shock test or a rotary bending test of a wheel. Therefore, the present invention greatly contributes to the development of industry.

TABLE 1

| sample No. | DAS measured values | sample No. | DAS measured values | sample No. | DAS measured values |
|---|---|---|---|---|---|
| 1-1a-8 | 26 μm | 1-1b-8 | 24 μm | 1-2a-8 | 25 μm |
| 1-1a-7 | 29 μm | 1-1b-7 | 30 μm | 1-2a-7 | 29 μm |
| 1-1a-8 | 34 μm | 1-1b-6 | 32 μm | 1-2a-6 | 29 μm |
| 1-1a-5 | 36 μm | 1-1b-5 | 30 μm | 1-2a-5 | 30 μm |
| 1-1a-4 | 26 μm | 1-1b-4 | 25 μm | 1-2a-4 | 24 μm |
| 1-1a-3 | 26 μm | 1-1b-3 | 25 μm | 1-2a-3 | 29 μm |
| 1-1a-2 | 33 μm | 1-1b-2 | 33 μm | 1-2a-2 | 35 μm |
| 1-1a-1 | 38 μm | 1-1b-1 | 33 μm | 1-2a-1 | 35 μm |
| 1-2b-8 | 25 μm | 2-1-8 | 23 μm | 3-1-8 | 46 μm |
| 1-2b-7 | 27 μm | 2-1-7 | 28 μm | 3-1-7 | 42 μm |
| 1-2b-8 | 29 μm | 2-1-6 | 29 μm | 3-1-6 | 33 μm |
| 1-2b-5 | 29 μm | 2-1-5 | 35 μm | 3-1-5 | 30 μm |
| 1-2b-4 | 22 μm | 2-1-4 | 22 μm | 3-1-4 | 20 μm |
| 1-2b-3 | 27 μm | 2-1-3 | 37 μm | 3-1-3 | 30 μm |
| 1-2b-2 | 30 μm | 2-1-2 | 40 μm | 3-1-2 | 30 μm |
| 1-2b-1 | 31 μm | 2-1-1 | 40 μm | 3-1-1 | 35 μm |

What is claimed is:

1. A cast aluminum alloy vehicle wheel, comprising:

a central disk;

a rim, said rim having a rim end or tip portion that is the farthest portion of said rim from said disk, and a barrel portion on said rim that is closer to said disk;

a rim carrying portion located intermediate said rim and said central disk, said barrel portion being located between said rim carrying portion and said rim end, a dendritic arm spacing (DAS) of the alloy grain structure at said rim end being smaller than the DAS at said barrel portion, the DAS at said rim carrying portion being less than the DAS at said central disk.

2. A cast aluminum alloy vehicle wheel, comprising:

a central disk;

a rim, said rim having a rim end or tip portion that is the farthest portion of said rim from said disk, and a barrel portion on said rim that is closer to said disk;

a rim carrying portion located intermediate said rim and said central disk, said barrel portion being located between said rim carrying portion and said rim end, a dendritic arm spacing (DAS) of the alloy grain structure at said rim end being smaller than the DAS at said barrel portion, the DAS at said rim carrying portion being less than the DAS at said central disk, and the DAS of said rim end being in the range 24–26 μm.

3. A cast aluminum alloy vehicle wheel, comprising:

a central disk;

a rim, said rim having a rim end or tip portion that is the farthest portion of said rim from said disk, and a barrel portion on said rim that is closer to said disk;

a rim carrying portion located intermediate said rim and said central disk, said barrel portion being located between said rim carrying portion and said rim end, a dendritic arm spacing (DAS) of the alloy grain structure at said rim end being smaller than the DAS at said barrel portion, the DAS at said rim carrying portion being less than the DAS at said central disk; and the DAS of said rim carrying portion being not greater than the DAS of said barrel portion, the DAS of said rim carrying portion being in the range 25–29 μm.

4. A cast aluminum alloy vehicle wheel, comprising:

a central disk;

a rim, said rim having a rim end or tip portion that is the farthest portion of said rim from said disk, and a barrel portion on said rim that is closer to said disk;

a rim carrying portion located intermediate said rim and said central disk, said barrel portion being located between said rim carrying portion and said rim end, a dendritic arm spacing (DAS) of the alloy grain structure at said rim end being smaller than the DAS at said barrel portion, the DAS at said rim carrying portion being less that the DAS at said central disk; and the DAS of said rim carrying portion being not greater than the DAS of said barrel portion, each of said DAS being in the range 24–38 μm.

5. A cast aluminum alloy vehicle wheel, comprising:

a central disk;

a rim, said rim having a rim end or tip portion that is the farthest portion of said rim from said disk, and a barrel portion on said rim that is closer to said disk;

a rim carrying portion located intermediate said rim and said central disk, said barrel portion being located between said rim carrying portion and said rim end, a dendritic arm spacing (DAS) of the alloy grain structure at said rim end being smaller than the DAS at said barrel portion, the DAS at said rim carrying portion being less than the DAS at said central disk; and the DAS of said rim carrying portion being not greater than the DAS of said barrel portion, the DAS of said rim end being in the range 24–26 μm, the DAS of said barrel portion being in the range 29–34 μm; the DAS of said rim carrying portion being in the range 25–29 μm.

6. A cast aluminum alloy vehicle wheel, comprising:

a central disk;

a rim, said rim having a rim end or tip portion that is the farthest portion of said rim from said disk, and a barrel portion on said rim that is closer to said disk;

a rim carrying portion located intermediate said rim and said central disk, said barrel portion being located between said rim carrying portion and said rim end, a dendritic arm spacing (DAS) of the alloy grain structure at said rim end being smaller than the DAS at said barrel portion, the DAS at said rim carrying portion being less than the DAS at said central disk; and the DAS of said rim carrying portion is not greater than the DAS of said barrel portion.

7. The wheel as in claim 6, wherein the DAS of said rim carrying portion is substantially equal to the DAS of said barrel portion.

8. The wheel as in claim 6, wherein the DAS of said barrel portion is greater than the DAS of said rim carrying portion.

* * * * *